US005758876A

United States Patent [19]

Frick et al.

[11] Patent Number: 5,758,876

[45] Date of Patent: Jun. 2, 1998

[54] BOARD GAME

[76] Inventors: Richard Frick, 14509 110 Avenue, Surrey, British Columbia, Canada, V3R 2A4; Ivica Beronja, 15524 91 A Avenue, Surrey, British Columbia, Canada, V3R 9W9

[21] Appl. No.: 853,357

[22] Filed: May 8, 1997

[51] Int. Cl.[6] ..... A63F 3/00

[52] U.S. Cl. ..... 273/248

[58] Field of Search ..... 273/242, 243, 273/248, 249

[56] References Cited

U.S. PATENT DOCUMENTS

| | | | |
|---|---|---|---|
| D. 135,580 | 4/1943 | Querness | 273/248 X |
| D. 150,065 | 6/1948 | Dock | 273/248 X |
| 2,787,469 | 4/1957 | Glover | 273/248 |
| 3,166,325 | 1/1965 | First | 273/248 X |
| 3,395,922 | 8/1968 | Garangiotis | 273/248 |
| 5,067,722 | 11/1991 | Wesner | 273/248 |
| 5,433,449 | 7/1995 | Sowek | 273/248 |
| 5,433,450 | 7/1995 | Vaillancourt | 273/248 |
| 5,498,005 | 3/1996 | Jacques | 273/248 |

*Primary Examiner*—William E. Stoll

[57] ABSTRACT

A new Board Game for challenging players to move all of their playing pieces from their start area to their home area. The inventive device includes a game board having a circuitous movement path disposed thereon, a plurality of sets of playing pieces for movement along the circuitous movement path of the game board, and a set of playing cards and a pair of dice each provided for determining movement along the circuitous movement path. The game board also has a plurality of starting lanes and plurality of finishing lanes disposed thereon. The starting lanes and the finishing lanes lead to and from the circuitous movement path, respectively.

15 Claims, 2 Drawing Sheets

FIG. 1
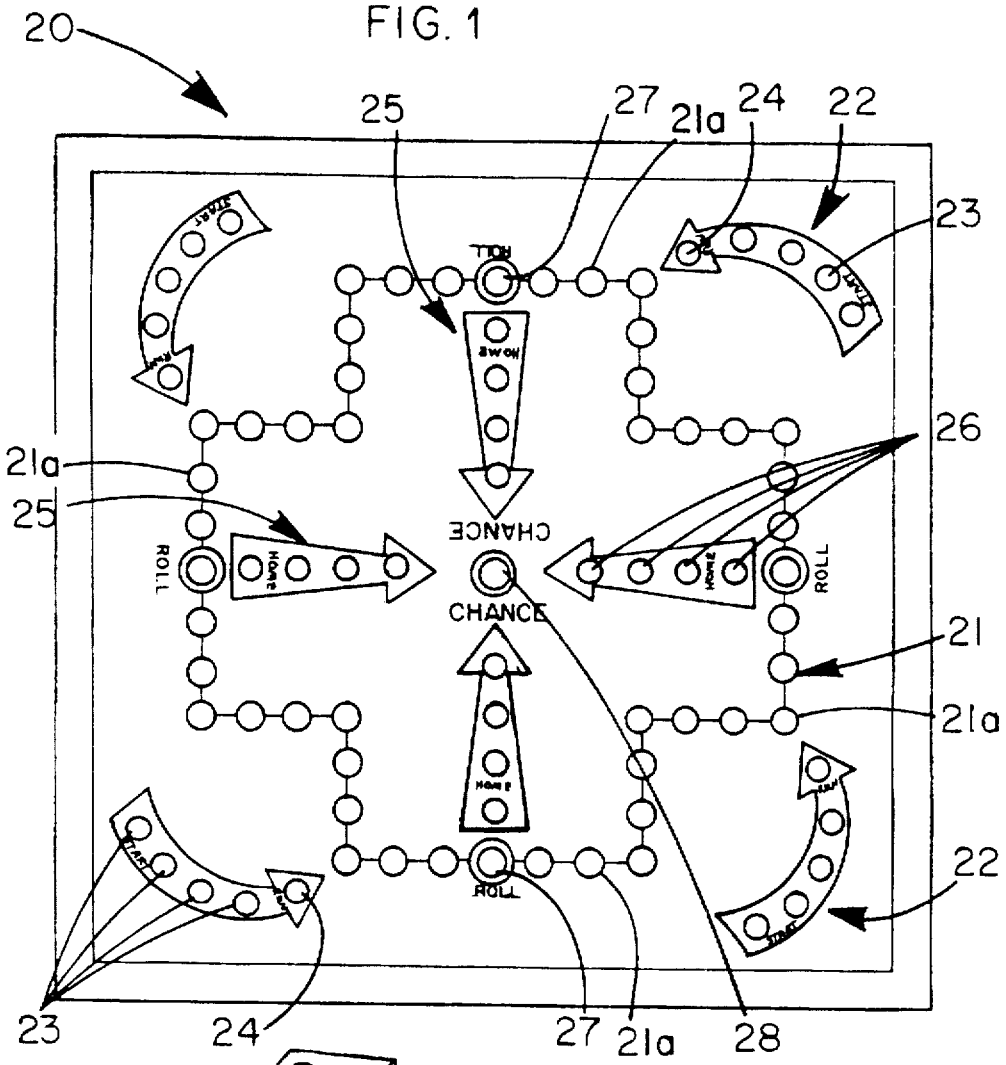
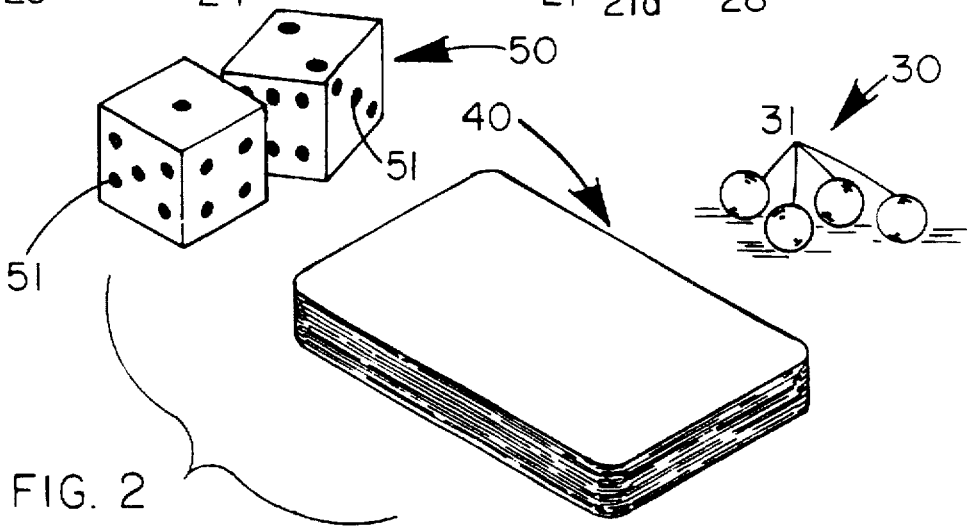
FIG. 2

BOARD GAME

BACKGROUND OF THE INVENTION

1. Field of the Invention

The present invention relates to board games and more particularly pertains to a new Board Game for challenging players to move all of their playing pieces from their start area to their home area.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art board games include U.S. Pat. No. 5,433,450; U.S. Pat. No. 4,551,103; U.S. Pat. No. 5,314,188; U.S. Pat. No. 4,900,032; U.S. Pat. No. 4,889,345; and U.S. Pat. No. 4,244,579.

While these devices fulfill their respective, particular objectives and requirements, the aforementioned patents do not disclose a new Board Game. The inventive device includes a game board having a circuitous movement path disposed thereon, a plurality of sets of playing pieces for movement along the circuitous movement path of the game board, and a set of playing cards and a pair of die each provided for determining movement along the circuitous movement path. The game board also has a plurality of starting lanes and plurality of finishing lanes disposed thereon. The starting lanes and the finishing lanes lead to and from the circuitous movement path, respectively.

In these respects, the Board Game according to the present invention substantially departs from the conventional concepts and designs of the prior art, and in so doing provides an apparatus primarily developed for the purpose of challenging players to move all of their playing pieces from their start area to their home area.

SUMMARY OF THE INVENTION

In view of the foregoing disadvantages inherent in the known types of board games now present in the prior art, the present invention provides a new Board Game construction wherein the same can be utilized for challenging players to move all of their playing pieces from their start area to their home area.

The general purpose of the present invention, which will be described subsequently in greater detail, is to provide a new Board Game apparatus and method which has many of the advantages of the board games mentioned heretofore and many novel features that result in a new Board Game which is not anticipated, rendered obvious, suggested, or even implied by any of the prior art board games, either alone or in any combination thereof.

To attain this, the present invention generally comprises a game board having a circuitous movement path disposed thereon, a plurality of sets of playing pieces for movement along the circuitous movement path of the game board, and a set of playing cards and a pair of die each provided for determining movement along the circuitous movement path. The game board also has a plurality of starting lanes and plurality of finishing lanes disposed thereon. The starting lanes and the finishing lanes lead to and from the circuitous movement path, respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Board Game apparatus and method which has many of the advantages of the board games mentioned heretofore and many novel features that result in a new Board Game which is not anticipated, rendered obvious, suggested, or even implied by any of the prior art board games, either alone or in any combination thereof.

It is another object of the present invention to provide a new Board Game which may be easily and efficiently manufactured and marketed.

It is a further object of the present invention to provide a new Board Game which is of a durable and reliable construction.

An even further object of the present invention is to provide a new Board Game which is susceptible of a low cost of manufacture with regard to both materials and labor, and which accordingly is then susceptible of low prices of sale to the consuming public, thereby making such Board Game economically available to the buying public.

Still yet another object of the present invention is to provide a new Board Game which provides in the apparatuses and methods of the prior art some of the advantages thereof, while simultaneously overcoming some of the disadvantages normally associated therewith.

Still another object of the present invention is to provide a new Board Game for challenging players to move all of their playing pieces from their start area to their home area.

Yet another object of the present invention is to provide a new Board Game which includes a game board having a circuitous movement path disposed thereon, a plurality of sets of playing pieces for movement along the circuitous movement path of the game board, and a set of playing cards and a pair of die each provided for determining movement along the circuitous movement path. The game board also has a plurality of starting lanes and plurality of finishing lanes disposed thereon. The starting lanes and the finishing lanes lead to and from the circuitous movement path, respectively.

Still yet another object of the present invention is to provide a new Board Game that would provide an enjoyable game that could be participated in for friendly competition and entertainment.

Even still another object of the present invention is to provide a new Board Game that allows individual players or teams of two players to compete against each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of a game board for accommodating up to four players according to the present invention.

FIG. 2 is an illustration of the pair of die, playing cards, and a set of playing pieces of the present invention.

DESCRIPTION OF THE PREFERRED EMBODIMENT

Figure 3:
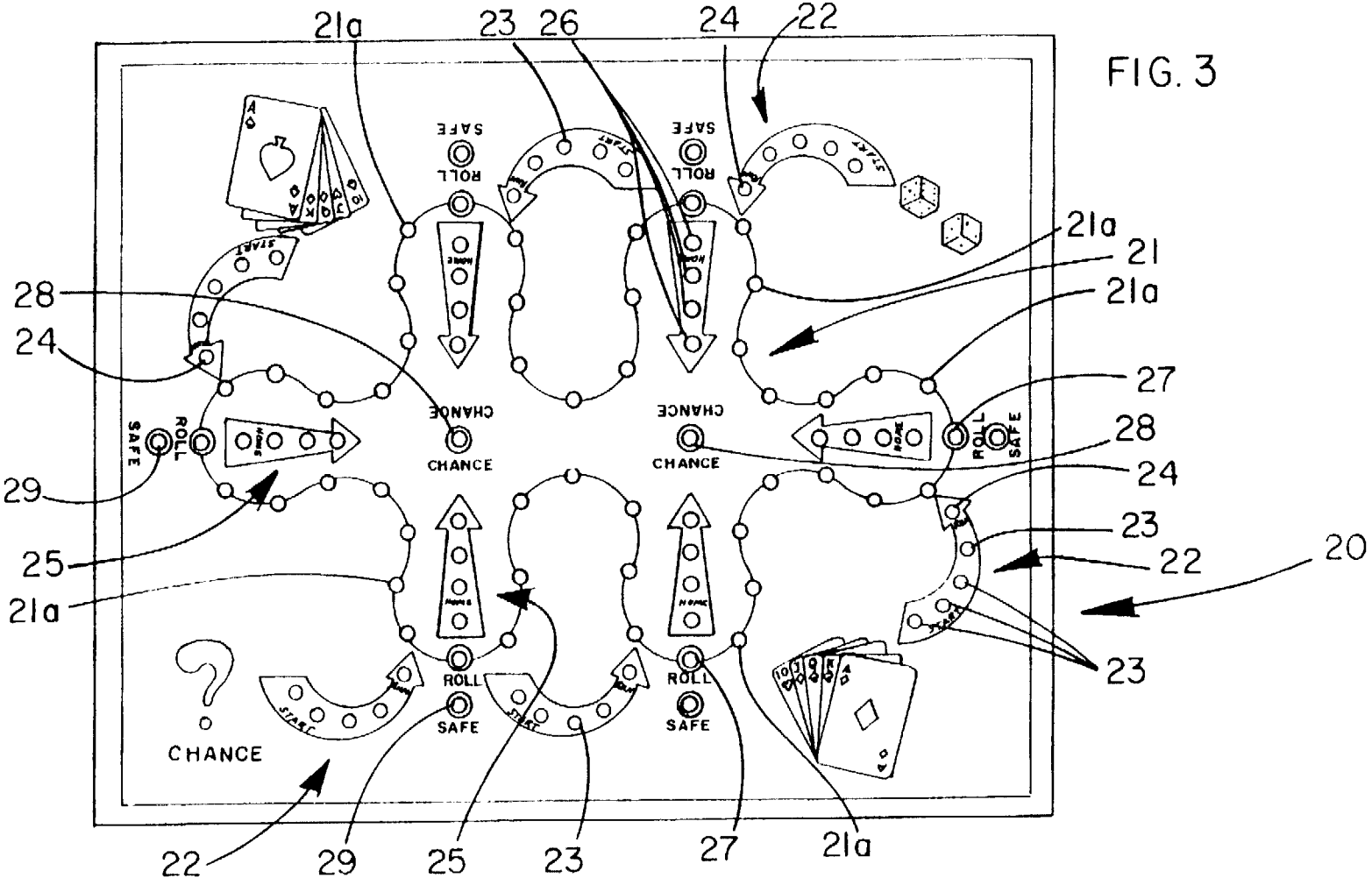
FIG. 3 is an illustration of a game board for accommodating up to six players according to the present invention.

With reference now to the drawings, and in particular to FIGS. 1 through 3 thereof, a new Board Game embodying the principles and concepts of the present invention and generally designated by the reference numeral 10 will be described.

As best illustrated in FIGS. 1 through 3, the Board Game 10 comprises a game board 20 having a circuitous movement path 21 disposed thereon, a plurality of sets of playing pieces 30 for movement along the circuitous movement path 21 of the game board 20, and a set of playing cards 40 and a pair of die 50 each provided for determining movement along the circuitous movement path 21. The game board 20 also has a plurality of starting lanes 22 and a plurality of finishing lanes 25 disposed thereon. The starting lanes 22 and the finishing lanes 25 lead to and from the circuitous movement path 21, respectively.

The game board 20 is substantially planar and generally rigid in structure. In addition, the game board 20 is generally rectangular in shape. The circuitous movement path 21 is a closed loop continuous path and is divided into a plurality of individual spaces 21*a*.

Each of the starting lanes 22 includes a number of holding spaces 23 and a starting space 24. The number of holding spaces 23 are collectively identified on the game board 20 as "START" and the starting space 24 is identified on the game board 20 as "RUN". The number of holding spaces 23 corresponds to a number of playing pieces 30 in each set thereof. In the preferred embodiment, the number of holding spaces 23 is four.

Each of the finishing lanes 25 includes a number of holding spaces 26, collectively identified on the game board 20 as "HOME". The number of holding spaces 26 corresponds to a number of playing pieces 30 in each set thereof. In the preferred embodiment, the number of holding spaces 26 is four.

A number of the individual spaces 21*a* are designated as a roll space 27 and, as such, are identified on the game board 20 as "ROLL". In the preferred embodiment, a roll space 27 is provided adjacent to each of the finishing lanes 25. Furthermore, a chance space 28, identified on the game board 20 as "CHANCE", is provided on the game board 20.

In addition, a safe space 29, identified on the game board 20 as "SAFE", may be provided on the game board 20. The safe space 29 is provided adjacent to one of the plurality of individual spaces 21*a* of the circuitous movement path 21. In the preferred embodiment, safe spaces 29 are provided adjacent each of the roll spaces 27.

Each of the spaces of the game board 20 are formed by an indentation in the game board 20. As such, each indentation is sized for removably holding a playing piece 30.

In a first embodiment, the game board 20 is designed to accommodate four players or two teams. As such, the game board 20 includes four starting lanes 22 and four finishing lanes 25. In the first embodiment, the circuitous movement path 21 is divided into forty-eight individual spaces 21*a*, four of which are roll spaces 27. One roll space 27 is provided adjacent each one of the finishing lanes 25. In addition, one chance space 28 is provided.

In a second embodiment, the game board 20 is designed to accommodate six players or three teams. As such, the game board 20 includes six starting lanes 22 and six finishing lanes 25. In the second embodiment, the circuitous movement path 21 is divided into forty-eight individual spaces 21*a*, six of which are roll spaces 27. One roll space 27 is provided adjacent each one of the finishing lanes 25. In addition, two chance spaces 28 are provided. Furthermore, six safe spaces 29 are provided. One safe space 29 is provided adjacent each one of the roll spaces 27.

In the preferred embodiment, each set of playing pieces 30 includes four playing pieces. Each of the playing pieces of a set have a common color and each set of playing pieces 30 has a unique color. As such, playing pieces of different sets are easily distinguished thereamong. In the first embodiment, four sets of playing pieces 30 are provided and in the second embodiment, six sets of playing pieces 30 are provided. Furthermore, in the preferred embodiment, each playing piece is a marble 31.

The set of playing cards 40 is a modified standard deck of playing cards that includes four additional aces and four additional kings. Traditionally, a standard deck of playing cards consists of four suits—hearts, diamonds, clubs, and spades—of 13 playing cards each for a total of 52 playing cards. Traditionally, each suit consists of an ace, a king, a queen, a jack, and 9 playing cards bearing pips from 2 to 10.

Accordingly, the set of playing cards 40 of the present invention comprises a standard deck of playing cards plus four playing cards each designated as an ace and four playing cards each designated as a king. As such, the set of playing cards 40 of the present invention comprises 60 playing cards including four playing cards each designated as each of the numbers 2 to 10, four playing cards each designated as a jack, four playing cards each designated as a queen, eight playing cards each designated as a king, and eight playing cards each designated as an ace.

Each of the pair of die 50 are six-sided die including indicia 51 thereon representing the numbers one to six.

Object of the Game

The object of the game is for each player to move all of their marbles from the START area clockwise around the game board to the HOME area.

Rules of Play

1. To begin play, each player selects a set of four marbles and places them in the corresponding START area. Each player is dealt five cards. (When playing with five players on the six-player board, each player is dealt six cards).

2. To enter the RUN position, and the game, a player must play a RUN CARD. A RUN CARD is either an Ace or a King. If a player does not have a RUN CARD, they must fold their hand.

3. Marbles are moved according to the value of the card played. An Ace is 1 move, a King is 13 moves, a Queen is 12 moves, and a Jack is 11 moves. Moves for the remaining, cards are defined by their face value. All cards that can be played must be played. Cards that cannot be played must be discarded.

4. A player cannot jump their own marble. Any time a player cannot play their cards they must fold their hand.

5. ROLL position—When a player lands on a ROLL position, they roll the dice (or may have the option of passing). If the player rolls a seven or higher, they move their marble to the CHANCE position. When a player already occupies the CHANCE position, they cannot enter the ROLL position and must move one space back from the ROLL position (This position may be identified on the game board as "BACK UP").

6. SAFE position—If the player does not roll a seven or higher (when occupying a ROLL position), they enter the SAFE position (if the game board does not include SAFE positions, the player must move one space back from the ROLL position). A player may remain in a SAFE position as long as they like.

7. CHANCE Position—When a player occupies a CHANCE position, they are allowed two rolls of the dice. If the player rolls doubles during either roll, they move their marble to any position in the HOME area. If the player does not roll doubles during either roll, they remain in the CHANCE position until the next hand. Before the player plays a card of the new hand, they must roll the dice twice for a double. If the player forgets to roll the die before playing a card, they forfeit their rolls.

8. Bumping A Player—If a player lands on a space occupied by an opponent (excluding the RUN, SAFE, and HOME positions), the player can bump the opponent back to their START area. If a player can bump an opponent from a CHANCE position and both CHANCE positions are occupied, the player has the option of deciding which to bump. A player cannot bump an opponent from a CHANCE position, if another CHANCE position is open.

9. Team Play—Partners sit opposite each other and play in turn. A player can use a RUN card to bring their partner out. After a player has all their own marbles in their HOME area, they may use their cards for moving their partner's marbles. A player having, a last remaining card that, when played, will cause them to bump their own partner, must play the card. A player may jump a partner's marble.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A board game, comprising:

a game board having a circuitous movement path disposed thereon, said circuitous movement path divided into a plurality of individual spaces, said game board having a plurality of non-movement starting lanes and a plurality of non-movement finishing lanes disposed thereon, each of said starting lanes leading to said circuitous movement path and each of said finishing lanes leading from said circuitous movement path;

a plurality of sets of playing pieces for movement along said circuitous movement path of said game board;

a set of playing cards; and a pair of dice, said set of playing cards and said pair of dice determining movement along said circuitous movement path.

2. The board game of claim 1, wherein each of said starting lanes includes a starting space, and wherein each of said starting lanes and each of said finishing lanes includes a number of holding spaces, said number of holding spaces corresponding to a number of playing pieces in each set thereof.

3. The board game of claim 2, wherein said number of holding spaces is four.

4. The board game of claim 1, wherein a number of said plurality of individual spaces of said circuitous movement path are designated as a roll space.

5. The board game of claim 4, wherein said roll space is provided adjacent each of said finishing lanes.

6. The board game of claim 4, further comprising:

a safe space provided on said game board, said safe space provided adjacent to one of said plurality of individual spaces of said circuitous movement path.

7. The board game of claim 6, wherein said safe space is provided adjacent each of said roll spaces.

8. The board game of claim 1, further comprising:

a chance space provided on said game board.

9. The board game of claim 1, wherein each of said individual spaces of said game board, said starting space of each of said starting lanes, and said holding spaces of each of said starting lanes and said finishing lanes are formed by an indentation in said game board, said indentation sized for removably holding a playing piece, and wherein said playing piece is a marble.

10. The board game of claim 1, wherein said game board includes four starting lanes and four finishing lanes, wherein said circuitous movement path is divided into forty-eight individual spaces, four of said forty-eight individual spaces designated as roll spaces, one roll space provided adjacent each one of said finishing lanes, wherein one chance space is provided, and wherein four sets of playing pieces are provided.

11. The board game of claim 1, wherein said game board includes six starting lanes and six finishing lanes, wherein said circuitous movement path is divided into forty-eight individual spaces, six of said forty-eight individual spaces designated as roll spaces, one roll space provided adjacent each one of said finishing lanes, wherein two chance spaces are provided, wherein six safe spaces are provided, one safe space provided adjacent each one of said roll spaces, and wherein six sets of playing pieces are provided.

12. The board game of claim 1, wherein each set of playing pieces includes four playing pieces, wherein each of said playing pieces of a set have a common color and each set of playing pieces has a unique color.

13. The board game of claim 1, wherein said set of playing cards includes four playing cards each designated as each of the numbers 2 to 10, four playing cards each designated as a jack, four playing cards each designated as a queen, eight playing cards each designated as a king, and eight playing cards each designated as an ace.

14. A method of playing a board game, comprising the steps of:

(a) providing a game board having a circuitous movement path disposed thereon, said circuitous movement path divided into a plurality of individual spaces, a number of said plurality of individual spaces designated as a roll space, said game board having a plurality of non-movement starting lanes and a plurality of non-movement finishing lanes disposed thereon, each of said starting lanes leading to said circuitous movement path and each of said finishing lanes leading from said circuitous movement path, each of said starting lanes including a starting space, each of said starting lanes and each of said finishing lanes including a number of holding spaces, said game board including a chance space;

(b) providing a plurality of sets of playing pieces;

(c) providing a set of playing cards and a pair of dice, a number of said playing cards designated as a run card;

(d) selecting a set of playing pieces and placing said playing pieces in said holding spaces of one of said starting lanes;

(e) dealing each player a predetermined number of playing cards;

(f) playing said run card and moving one of said playing pieces to said starting space;

(g) playing one playing card and moving said playing piece a number of spaces along said circuitous movement path of said game board according to a predetermined value of said played playing card;

(h) rolling said pair of dice when a player lands on said roll space and performing at least one of (i) moving said playing piece to said chance space if said player rolls at least a seven and (ii) moving said playing piece back one space if said player does not roll at least a seven;

(i) rolling said pair of dice when a player occupies said chance space and moving said playing piece to one of said holding spaces of one of said finishing lanes if said player rolls doubles;

(j) returning a playing piece to one of said holding spaces of one of said starting lanes if a player lands on a space currently occupied by an opponent; and (k) repeating steps (e) through (j) above until a player has all playing pieces of one set thereof in said holding spaces of one of said finishing lanes.

15. The method of claim 14, wherein said game board provided in step (a) includes a safe space, and wherein step (h) includes the step of (iii) moving said playing piece to said safe space if said player does not roll at least a seven.

* * * * *